United States Patent [19]

Fontana et al.

[11] 4,375,605

[45] Mar. 1, 1983

[54] ELLIPSOIDAL ENVELOPE FOR INCANDESCENT LAMP WITH INFRARED ENERGY RETURN MEANS

[75] Inventors: Raymond P. Fontana, Waldwick; Peter Walsh, Stirling, both of N.J.

[73] Assignee: Duro-Test Corporation, North Bergen, N.J.

[21] Appl. No.: 264,234

[22] Filed: May 18, 1981

Related U.S. Application Data

[63] Continuation of Ser. No. 76,358, Sep. 17, 1979, abandoned.

[51] Int. Cl.[3] ..... H01K 1/14

[52] U.S. Cl. ..... 313/112; 313/113

[58] Field of Search ..... 313/112, 113

[56] References Cited

U.S. PATENT DOCUMENTS 4,160,929 7/1979 Thorington et al. ..... 313/112

*Primary Examiner*—David C. Nelms
*Assistant Examiner*—Darwin R. Hostetter
*Attorney, Agent, or Firm*—Darby & Darby

[57] ABSTRACT

An incandescent electric lamp having a coating to reflect infrared energy back to the filament to raise its operating temperature in which the envelope is shaped as an ellipsoid and the filament and envelope have a relationship to reduce losses due to aberration and to produce a more uniform temperature distribution along the filament.

9 Claims, 4 Drawing Figures

ELLIPSOIDAL ENVELOPE FOR INCANDESCENT LAMP WITH INFRARED ENERGY RETURN MEANS

This is a continuation of application Ser. No. 076,358, filed Sept. 17, 1979 abandoned.

BACKGROUND OF THE INVENTION

The use of a visible transmitting infrared reflecting coating on the envelope of an incandescent lamp to reflect infrared energy back to the filament to raise its operating temperature and thereby reduce the amount of energy consumed by the filament to a desired temperature is known. A typical approach is to use optically precise spherical envelopes and a compact filament which is located at the optical center of the envelope. A lamp of this type is shown in U.S. Pat. No. 4,160,929, granted July 10, 1979, which is assigned to the assignee of this invention. Using such an approach, energy savings in excess of 50% with the coating of the foregoing patent in a spherical envelope is theoretically attainable. This corresponds to an increase in luminous efficacy in excess of about 2 times that attainable in a normal lamp operating at the same filament temperature.

From a practical point of view, it is not possible to make either a point source or a spherical filament. In general, it has been determined that an elongated filament, either coiled-coil or triple coiled which is either horizontally or vertically mounted with respect to a spherical envelope is the most practical embodiment of lamp to be made with an infrared reflecting coating. However, when an optically precise spherical reflector is used in conjunction with a non-spherical, such as an elongated, filament some of the radiation returned from the reflector on the envelope is lost due to aberration at the ends of the filament. Once this radiation is lost on one reflection, it is essentially lost for all subsequent reflections from the envelope reflective coating unless some type of recovery mechanism is employed.

The present invention relates to an improved incandescent lamp in which the envelope is ellipsoidal in shape and has a coating for reflecting infrared energy. The filament is in the form of an elongated cylinder which is centered inside of the reflecting envelope. The ellipsoidal envelope is designed such that its two foci are located on the axis of the filament and at predetermined distances from each end of the filament to reduce the aberrational losses. By using this approach, the aberrational losses can be reduced to about half that of a sphere enclosing the same cylindrical filament. Also, the use of an ellipsoidal element concentrates the returned IR radiation at two points of predetermined distances from the ends of the filament rather than at a single point. This makes the temperature gradient more uniform.

It is, therefore, an object of the present invention to provide an incandescent lamp whose envelope has an infrared reflective coating means in which the envelope is in the shape of an ellipsoid.

Another object is to provide an incandescent lamp with an ellipsoidal envelope having its foci lying along the axis of an elongated filament.

A further object is to provide an incandescent lamp whose envelope is in the shape of the ellipsoid, with the ellipsoid design such that the two foci of the ellipsoid are located at a predetermined distance from each end of the filament.

Other objects and advantages of the present invention will become more apparent upon reference to the following specification and annexed drawings in which.

Figure 1:
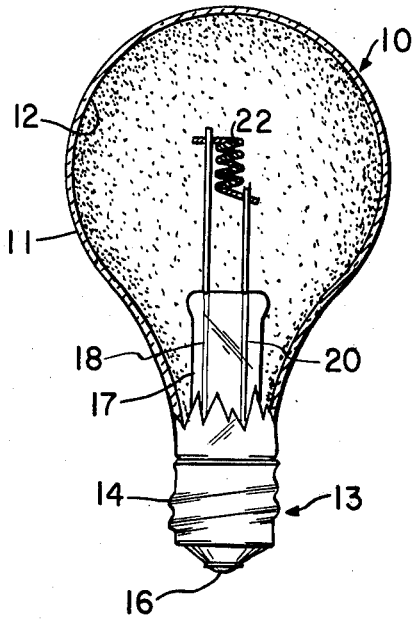
FIG. 1 PRIOR ART
FIG. 1 is an elevational view in section of a prior art incandescent lamp.

FIG. 1 shows a type of prior art incandescent lamp 10. The lamp includes an envelope 11 which is preferably of a desired optical shape, the illustrative shape being shown as being spherical except at the base portion. The lamp has a mechanism for returning infrared (IR) energy produced by the filament upon incandescence to the filament. The lamp 10 has coated on the major part of its spherical surface, either internally or externally, a coating 12 which is highly transparent to visible wavelength energy and highly reflective to IR wavelength energy. A suitable coating is described in the af resaid U.S. Pat. No. 4,160,929, granted July 10, 1979, and which is assigned to the same assignee. Other coatings can be used.

A filament 22 is mounted on a pair of lead-in wires 18, 20 held in an arbor or stem, 17. The lead-in wires 18,20 are brought out through the arbor to electrical contacts 14,16 on a base 13. Arbor 17 also has a tubulation (not shown) through which the interior of the lamp envelope is exhausted and filled, if desired, with a gas. Suitable gases are, for example, argon, a mixture of argon-nitrogen, or a high molecular weight gas, such as krypton. The lamp also can be operated as a vacuum type.

When voltage is applied to the lamp, the filament 22 incandesces and produces energy in both the visible and the IR range. The exact spectral distribution of the filament depends upon the resistance of the filament. Typical filament operating temperatures are in the range of from about 2650° K. to about 2900° K., although operation at a temperature as low as 2000° K. and as high as 3050° K. can be used. As the filament operating temperature increases, the spectral distribution shifts further to the red, i.e. it produces more infrared energy.

The coating 12, in combination with the optical shape of the lamp, serves to reflect back to the filament a substantial, and preferably as large a portion as possible, i.e. about 85% or more, of the IR energy produced by the filament. When the energy is reflected back to the filament, it increases its operating temperature and thereby decreases the power (wattage) required to operate the filament at this temperature.

Figure 2:
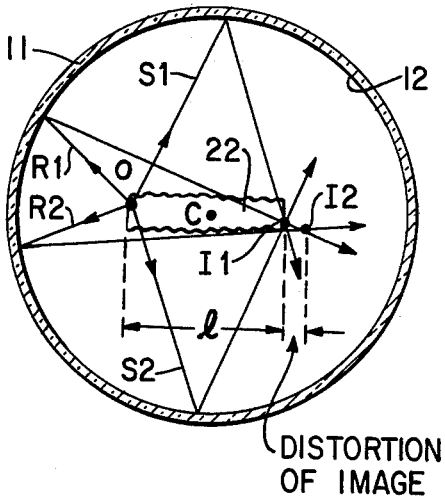
FIG. 2 is a side view of the lamp of FIG. 1 illustrating the aberrational effects.

FIG. 2 shows how the aberrational effects from the ends of the filament are produced. This shows the lamp cross-section along the longitudinal axis of the envelope. For purposes of explanation, it is considered that the envelope is a closed sphere in this direction. Consider that the filament 22 has a length l and that the center of this filament C is located at the optical center of the spherical envelope. The filament also is in the general form of a cylinder having a diameter D. Considering the rays which originate from one end O of the filament at a point off the longitudinal axis as it incandesces, these rays are produced effectively at a variety of angles covering a spherical surface. Two such rays $R_1$ and $R_2$ are shown which are given off at an angle which is substantially acute with respect to the axis of the filament. Two other rays $S_1$ and $S_2$ are shown which are produced at angle which is somewhat obtuse with respect to the longitudinal axis of the filament. As shown, the image point for the rays $R_1$ and $R_2$ will be near the image point $I_2$, which is outside of the filament, while the image points for the rays $S_1$ and $S_2$ will be near the image point $I_1$, which is at the end of the filament. It can be shown that for all of the rays originating from the end point O that the image points for many of these rays lie in a region outside of the end of the filament opposite the end O. The infrared energy which is not re-imaged back onto the filament is lost unless recaptured.

A similar analysis can be made for the rays which are emitted from the end of the filament opposite O. An analysis is presented below for calculating these end losses.

The total aberration losses arise from image distortion associated with the sides, or outside surface of the filament, as well as its ends. The losses from the sides occur because the filament geometry does not precisely conform to the shape of the envelope so that the wavefront of rays from the sides of the filament also does not exactly correspond to the envelope and there will be some aberration when they are reflected back to the filament.

It can be shown that the aberrational losses $L_c$ from the sides of an elongated filament centered at the optical center of an optically precise sphere of radius R is as follows:

$$L_c = \frac{1}{3\pi} \frac{l}{R} \frac{E_c A_c}{(E_c A_c + E_e A_e)} \tag{1}$$

Where:

l is the filament length

R is the radius of the filament cylinder.

$A_c$ is the surface area of the cylinder assumed for the diameter of the filament.

$A_E$ is the end area of the filament.

$E_c$ is the emissivity of the cylinder.

$E_e$ is the emissivity of the end of the filament.

For a filament 13.0 mm long in an 80 mm G-25 spherical glass enclosure for $E_c$ equals 0.55 and an $E_e$ of approximately 1, the side losses $L_c$ can be calculated to be about 3.1%. That is, this amount of infrared energy will not re-image onto the filament and will be lost.

Figure 3:
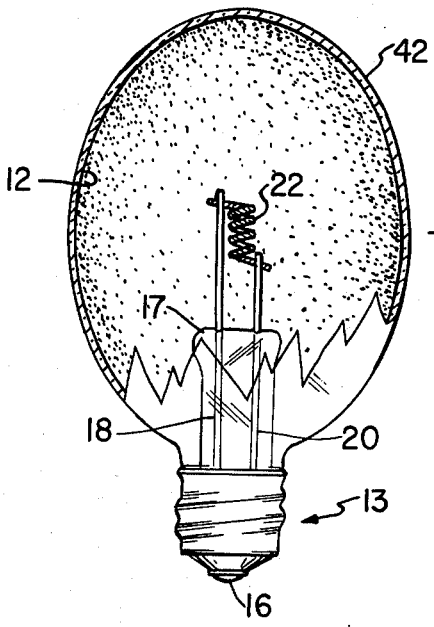
FIG. 3 is an elevational view of an ellipsoidal envelope showing the principles of the invention.
Figure 4:
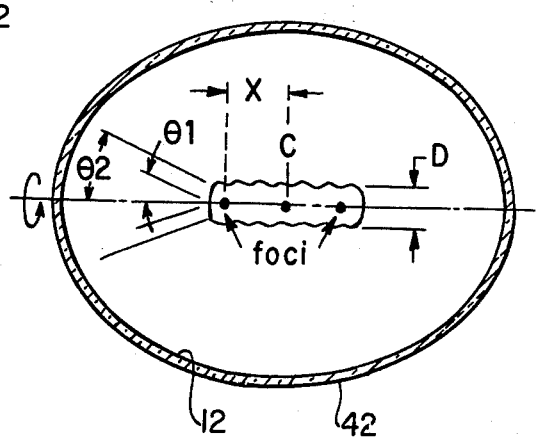
FIG. 4 is a cross-sectional view of the lamp of FIG. 3 showing the placement of the filament.

FIG. 3 shows an ellipsoidal envelope made to reduce the end losses while FIG. 4 is a schematic elevational view to demonstrate the design of the ellipsoidal envelope and the location of the center of the filament. In FIG. 4, for the purposes of explanation the envelope is assumed to be fully ellipsoidal.

In FIG. 3, the same reference numerals have been used as in FIG. 1. As seen, the envelope 42 is of an ellipsoidal shape, that is, an ellipse is taken and rotated by 360° to produce the ellipsoid. The envelope has a base 13 with stem and tubulation. The incandescent filament 22, which is preferably coiled-coil or triple coiled, is treated as a cylinder whose axis lies along the major axis of the ellipse. The envelope 42 is coated, either on the interior or the exterior with the IR reflective and visible transmissive coating 12.

Referring to FIG. 4, the envelope 42 is designed with respect to the filament so that the location of the foci of the ellipse are positioned to minimize the sum of end and side aberrations. In an ellipsoid, rays emitted near one of the foci points located along the length of the filament will be reflected by the coating on the envelope wall back to companion points near the foci points on the opposite side, considering the center C as a dividing line, of the filament from which the ray is emitted. Usually one internal reflection is required. However, the visible energy passes out through the coating, by an amount determined by the coating transmittance, on the first impingement of the coating.

Rays emitted from near the foci points have no aberration. However, there is still aberration at the ends of the filament due to distortion.

In an IR reflecting envelope, whether spherical or ellipsoidal, The image of a ray emitted from the end of the filament at an angle $\theta$ with respect to the filament axis, forms at some distance S behind the opposite given by the equation $$S(\theta) = \frac{2(l/2)^2 \cos^2\theta}{R} \tag{2}$$

The distance from the end of the filament to the center is l/2. Thus, at some range of angles of rays emitted by each end of the filament, there will be a loss, that is, the rays will not re-image on the opposite end of the filament after reflection from the coating. It can be shown that the rays within the solid angle between $\theta_1$ and $\theta_2$ are lost to the filament. That is, the rays from the left end of the filament between the two conical angles are not intercepted by the filament.

The end loss $L_E$ can be calculated to be $$L_E = (\cos^2\theta_1 - \cos^2\theta_2)\left[\frac{E_e A_e}{E_e A_e + E_c A_c}\right] \tag{3}$$

where, the other quantities have been defined above

For the 13 mm long filament in an 80 mm diameter G-25 envelope, $\theta_1$ and $\theta_2$ are about 10.8° and 64.3°. The end aberration loss $L_E$ is about 6.8% and the side is about 3.1%, as previously discussed, giving a total of 9.9%. This would be the loss in a spherical enclosure where the elongated filament was precisely optically centered.

To determine dimensions of the ellipse to minimize the aberration losses, it is considered that for an ellipse that is not too eccentric, that the end aberration will depend upon the distance from one of the foci in the same manner as the aberration depends upon the distance of the end of the filament from the center of the sphere. This spherical aberration depends on the square of the distance from the center and it is assumed that the elliptical aberration depends on the square of the distance from the nearest of the two foci located at a distance $\pm X$ from the ellipse center. The elliptical aberration loss L is then taken as the sum of both the end and side losses.

$$L = L_e \frac{\left(\frac{l}{2} - X\right)^2}{\left(\frac{l}{2}\right)^2} + L_c \frac{\left[\left(\frac{l}{2} - X\right)^2 + X^2\right]}{\left(\frac{l}{2}\right)^2} \tag{4}$$

where, $L_c$=the loss along the cylinder.

The terms $(1/2-X)^2$ and $X^2$ in the brackets arise from side aberration away from the ellipse center and toward the ellipse center. When $X=0$, the ellipse degenerates into a sphere and:

$$L=L_E+L_c, \text{ as required.}$$

The minimum aberration is given by setting $dL/dX=0$. Solving this equation leads to:

$$\frac{X}{l/2} = \frac{(L_E + L_c)}{L_E + 2L_c} \quad (5)$$

If $L_E=0$, X is half way to a filament end from the center. That is, the foci is located at X by a distance one-fourth of the length of the filament from the end of the filament. At this location of the foci, the elliptical aberration is one-quarter of the aberration of a filament in a spherical envelope.

If $L_c=0$, then X is at the filament end and there is no elliptical aberration. Thus, the spherical aberration is reduced by a factor one-fourth or less within the ellipse.

In a practical example, $X=0.76$ (l/2) and the foci are located about three-fourths of the distance from the center to an end. The total aberration loss is then about 2.4% compared to about 9.9% in a sphere.

As mentioned, the use of the ellipsoid having two foci has further advantages in that the reflected IR radiation will be concentrated about two points, the foci, rather than about a single point in a sphereical geometry. This makes the temperature more evenly distributed along the length of the filament. Further, the returned energy will be focussed at two points rather than one and there will be less defocusing in between. Since the luminous efficacy of a filament is a function of temperature, decreasing at the cooler positions, the more even temperature distribution will produce a greater lumen output. Also, unequal temperature gradients lead to shorter filament lives and the more even temperature gradient helps to eliminate this.

What is claimed is:

1. An incandescent electric lamp comprising:

an ellipsoidal shaped envelope having a base portion, said envelope defining a major axis on which is a pair of spaced focal points, an incandescent filament mounted within said envelope, means for supplying electrical energy to said filament to cause it to incandesce to produce energy in both the infrared and the visible range, means for cooperating with said envelope to return to the filament a substantial portion of the infrared energy produced by said filament and for transmitting therethrough a substantial portion of the visible range energy produced by said filament;

said filament being elongated, generally cylindrical and linear along its major axis, at least as long as the distance between the two foci of the major axis of the envelope, and being mounted along the major axis of the ellipsoidal envelope so that the two foci of the ellipsoid are located on the filament a spaced points therealong.

2. An incandescent electric lamp as in claim 1 wherein each foci is located at a distance from between a respective end of the filament to about one half of the distance to the center of the filament.

3. An incandescent electric lamp as in claim 2 wherein each foci is located at a respective end of the filament to minimize side losses.

4. An incandescent electric lamp as in claim 2 wherein each foci is located about one half of the distance from a respective end of the filament to the center of the filament.

5. An incandescent electric lamp as in claim 2 wherein each foci is located at about three fourths of the distance from the center of the filament to a respective end.

6. An incandescent electric lamp as in claim 1 wherein said cooperating means comprises a coating on the envelope wall.

7. An incandescent electric lamp as in claim 1 wherein each foci is located at a distance from a respective end of the filament to its center such as to produce a more uniform temperature distribution along the filament.

8. An incandescent electric lamp as in claim 1 wherein the two foci are each located at respective points along the length of the filament to reduce side or end aberration losses.

9. An incandescent electric lamp as set forth in claim 1 when the filament is longer than the distance between the foci.

* * * * *